US010704858B1

(12) United States Patent
Mason et al.

(10) Patent No.: US 10,704,858 B1
(45) Date of Patent: Jul. 7, 2020

(54) VIBRATION DAMPENER FOR ARCHERY BOW

(71) Applicant: Gregory E. Summers, Madison Heights, VA (US)

(72) Inventors: Tristan Mason, Madison Heights, VA (US); Gregory E. Summers, Amherst, VA (US)

(73) Assignee: Gregory E. Summers, Madison Heights, VA (US)

( * ) Notice: Subject to any disclaimer, the term of this patent is extended or adjusted under 35 U.S.C. 154(b) by 0 days.

(21) Appl. No.: 16/401,578

(22) Filed: May 2, 2019

(51) Int. Cl.
*F41B 5/20* (2006.01)
*F41B 5/14* (2006.01)

(52) U.S. Cl.
CPC ..... *F41B 5/1426* (2013.01)

(58) Field of Classification Search
CPC ..... F41B 5/1426
See application file for complete search history.

(56) References Cited

U.S. PATENT DOCUMENTS 4,615,327 A * 10/1986 Saunders ..... F41B 5/1426 124/89
5,339,793 A * 8/1994 Findley ..... F41B 5/1426 124/89
5,975,070 A * 11/1999 Sands ..... F41B 5/1426 124/89
6,186,135 B1 * 2/2001 Harwath ..... F41B 5/1426 124/89
6,745,757 B2 * 6/2004 Sims ..... F41B 5/1426 124/89
6,817,352 B1 * 11/2004 Saunders ..... F41B 5/1426 124/89
7,213,590 B2 * 5/2007 Pellerite ..... F41B 5/1426 124/89
8,418,683 B2 * 4/2013 Leven ..... F41B 5/1426 124/89
9,016,268 B2 4/2015 Leven
9,766,033 B2 9/2017 Powell

* cited by examiner

*Primary Examiner* — John A Ricci
(74) *Attorney, Agent, or Firm* — Laubscher & Laubscher, P.C.

(57) ABSTRACT

A vibration dampener for an archery bow includes a cylindrical sleeve containing a chamber and a unitary elastomeric member arranged in the chamber. The elastomeric member is pressurized to press against an inner surface of the sleeve and absorb vibrations from the bow during execution of an archery shot. The pressure applied to the elastomeric member may be fixed or it may be adjustable through use of a compression assembly.

31 Claims, 12 Drawing Sheets

VIBRATION DAMPENER FOR ARCHERY BOW

BACKGROUND OF THE DISCLOSURE

Professional archers often use a stabilizer with their bow to improve their accuracy. Similarly, hunters may also use a stabilizer as well. A stabilizer is typically screwed into an accessory hole on the bow, whether it by a compound or an Olympic bow. The stabilizer resists torque and absorbs vibrations in the bow when shot, thereby reducing the shock felt in the archer's hand on the bow grip. It also helps keep the bow balanced and settles the archer's arm during aiming.

To further dampen vibrations, a vibration dampener is often connected with the stabilizer.

BRIEF DESCRIPTION OF THE PRIOR ART

Vibration dampeners for archery bows are known in the patented prior art as shown in U.S. Pat. Nos. 9,016,268 and 9,766,033. For example, U.S. Pat. No. 9,016,268 discloses an adjustable mechanical vibration limiting and absorbing device including spaced groups of resilient washers arranged in a cylindrical housing. An exterior weight is operable to compress the washers so that expand against an inner surface of the housing to absorb vibrations.

While the prior vibration dampeners operate satisfactorily, they are limited to the amount of vibration that can be absorbed. This also limits the range of vibrations that can be reduced and absorbed. The present invention was developed in order to provide improved vibration dampening capabilities and adjustability of the degree of vibration absorption that is available with convention dampeners.

SUMMARY OF THE INVENTION

Accordingly, it is a primary object of the invention to provide a vibration dampener for a bow stabilizer including a cylindrical sleeve containing a chamber and an elastomeric member arranged in the chamber. The elastomeric member is pressurized to press against an inner surface of the chamber to absorb vibrations within the dampener.

The cylindrical sleeve is mounted on a base which is connected with the bow stabilizer. The base includes a coupler portion which extends into a through opening of the elastomeric member. In addition, a coupler pin has a first end connected with the base coupler portion. The second end of the pin is connected with a compression member, with the cylindrical sleeve and elastomeric member being arranged between the base and the compression member.

In a first embodiment, the compression member has a cylindrical configuration and contains an opening in a side wall portion for receiving a dowel pin. The dowel pin passes through the sleeve and through a through opening in the second end of the coupler pin to connect the compression member with the coupler pin and apply constant pressure to the elastomeric member.

In a second embodiment, the compression member is part of a compression assembly which is operable to adjust the pressure applied to the elastomeric member thereby to adjust the dampening effect of the dampener. More particularly, the compression assembly includes a pull stud having one end connected with the second end of the coupler pin and a threaded end, the compression member being threadably connected with the pull stud threaded end. A press plate mounted on the pull stud threaded end and arranged between an end of the elastomeric member and the compression member. Rotation of the compression member in opposite directions relative to the pull stud displaces the press plate toward and away from the elastomeric member to control the pressure applied to the elastomeric member. A locking screw is connected with the compression member to lock the compression member in a selected position relative to the pull stud.

According to a further embodiment, the degree to which pressure is applied to the elastomeric member can be restricted between minimum and maximum levels. More particularly, the compression assembly includes an adjustment tube which rotates and axially compresses the elastomeric member to press the elastomeric member radially against the inner surface of the cylindrical sleeve. First and second base members are connected with the adjustment tube to limit the rotation of the tube to define a range of pressure applied to the elastomeric member.

In each embodiment, the coupler pin preferably has at least one partially spherical end which is retained in the coupler portion of the base coupler portion by a dowel pin. The spherical configuration of the end of the coupler pin allows it to oscillate relative to the base coupler portion.

BRIEF DESCRIPTION OF THE FIGURES

Other objects and advantages of the invention will become apparent from a study of the following specification when viewed in the light of the accompanying drawing, in which.

DETAILED DESCRIPTION

Figure 1:
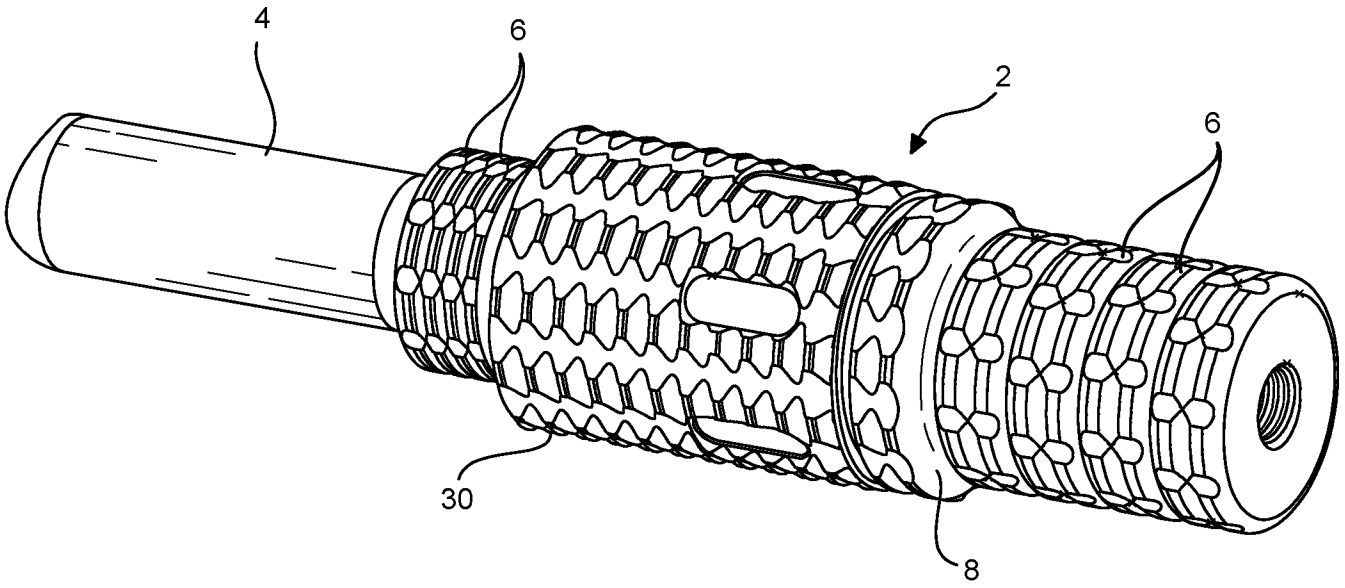
FIG. 1 is a front perspective view of a first embodiment of a vibration dampener mounted on an archer bow stabilizer according to the disclosure.
Figure 2:
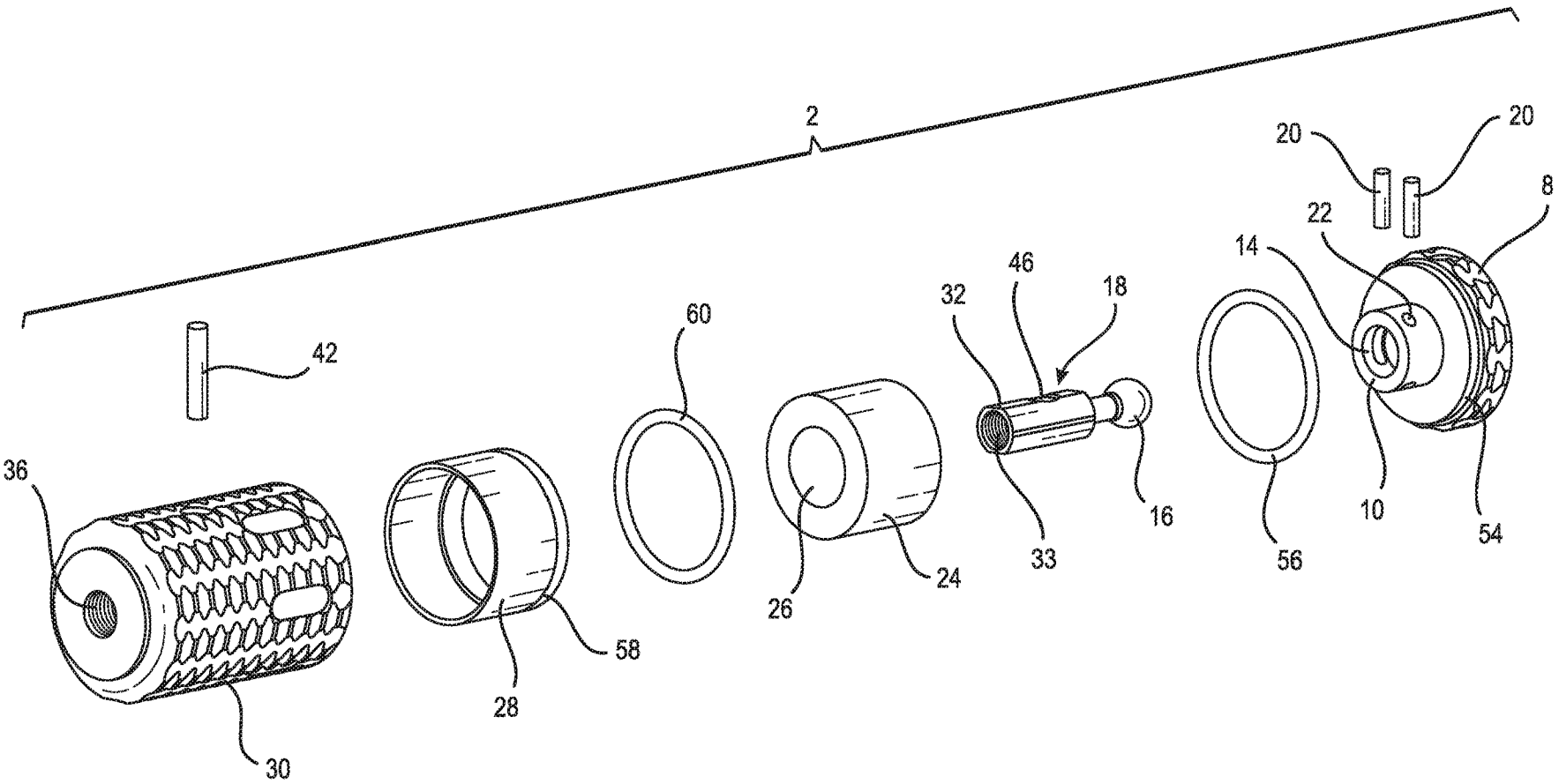
FIG. 2 is an exploded perspective view of the dampener of FIG. 1.

A first embodiment of a vibration dampener 2 for an archery bow stabilizer 4 is shown in FIG. 1. The dampener is mounted on the stabilizer, typically via a screw connection. A plurality of annular weights 6 may also be amounted on the stabilizer adjacent to one or both ends of the dampener. The dampener will be described in more detail in connection with FIGS. 2-4.

Figure 4:
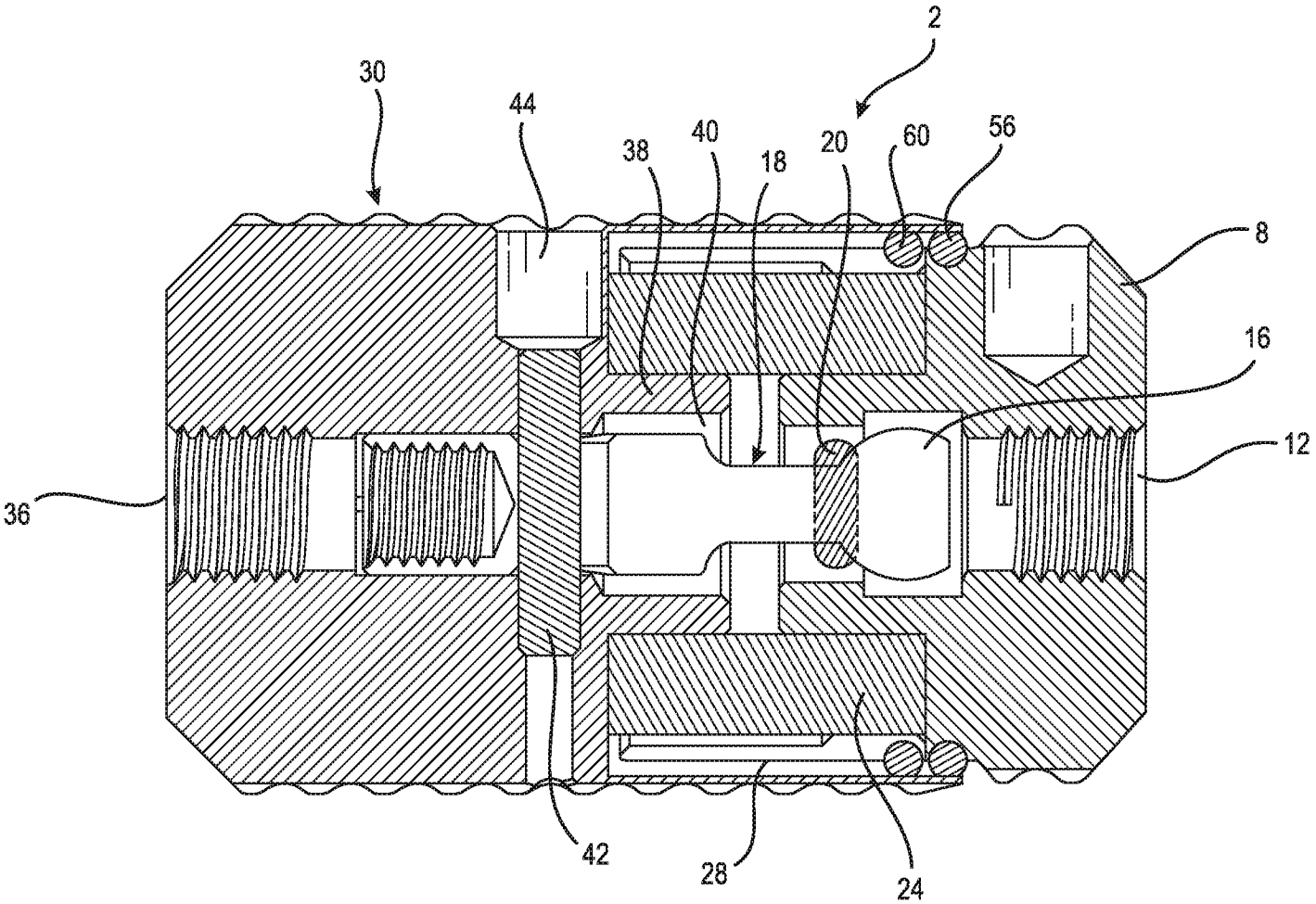
FIG. 4 is a sectional view of the assembled dampener of FIG. 1 taken along its axis.
Figure 5:
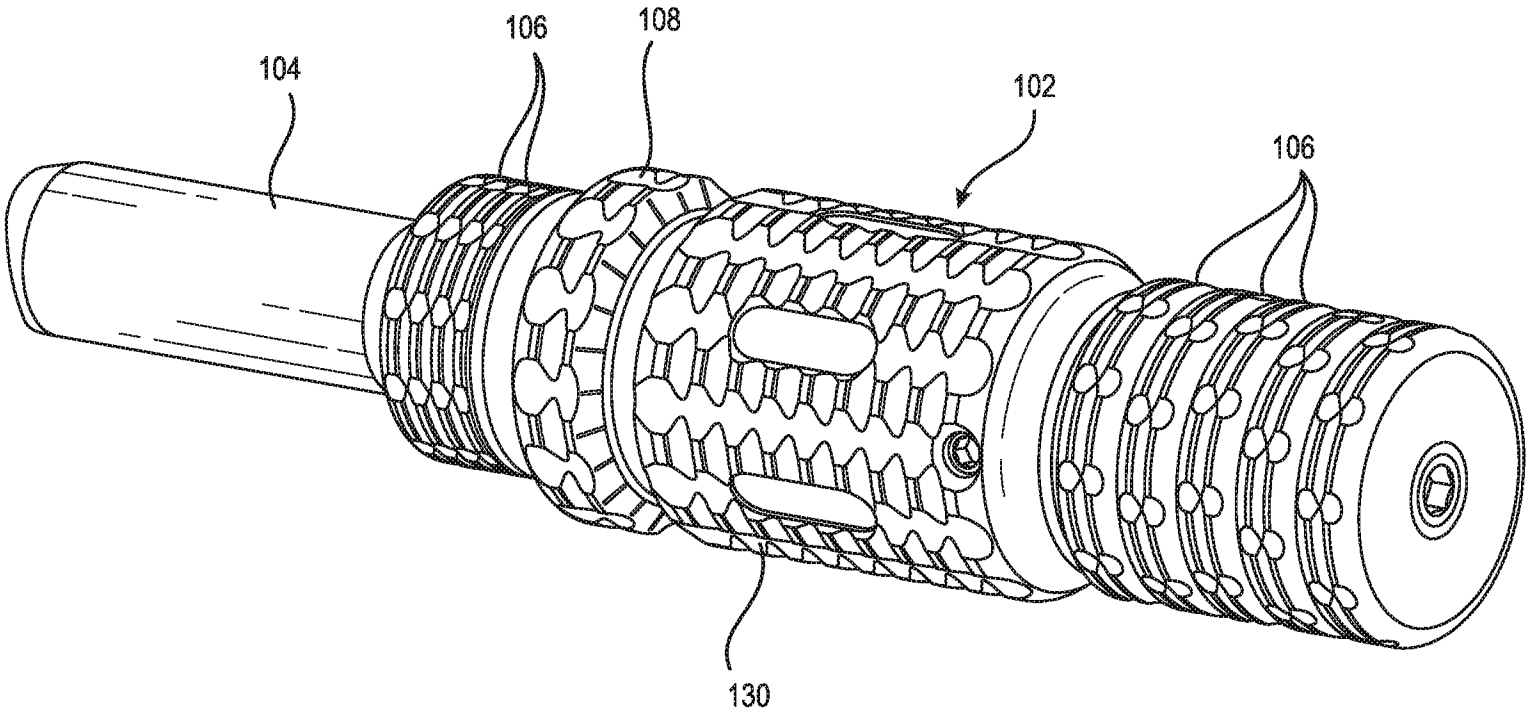
FIG. 5 is a front perspective view of a second embodiment of a vibration dampener mounted on an archery bow stabilizer according to the disclosure.
Figure 6:
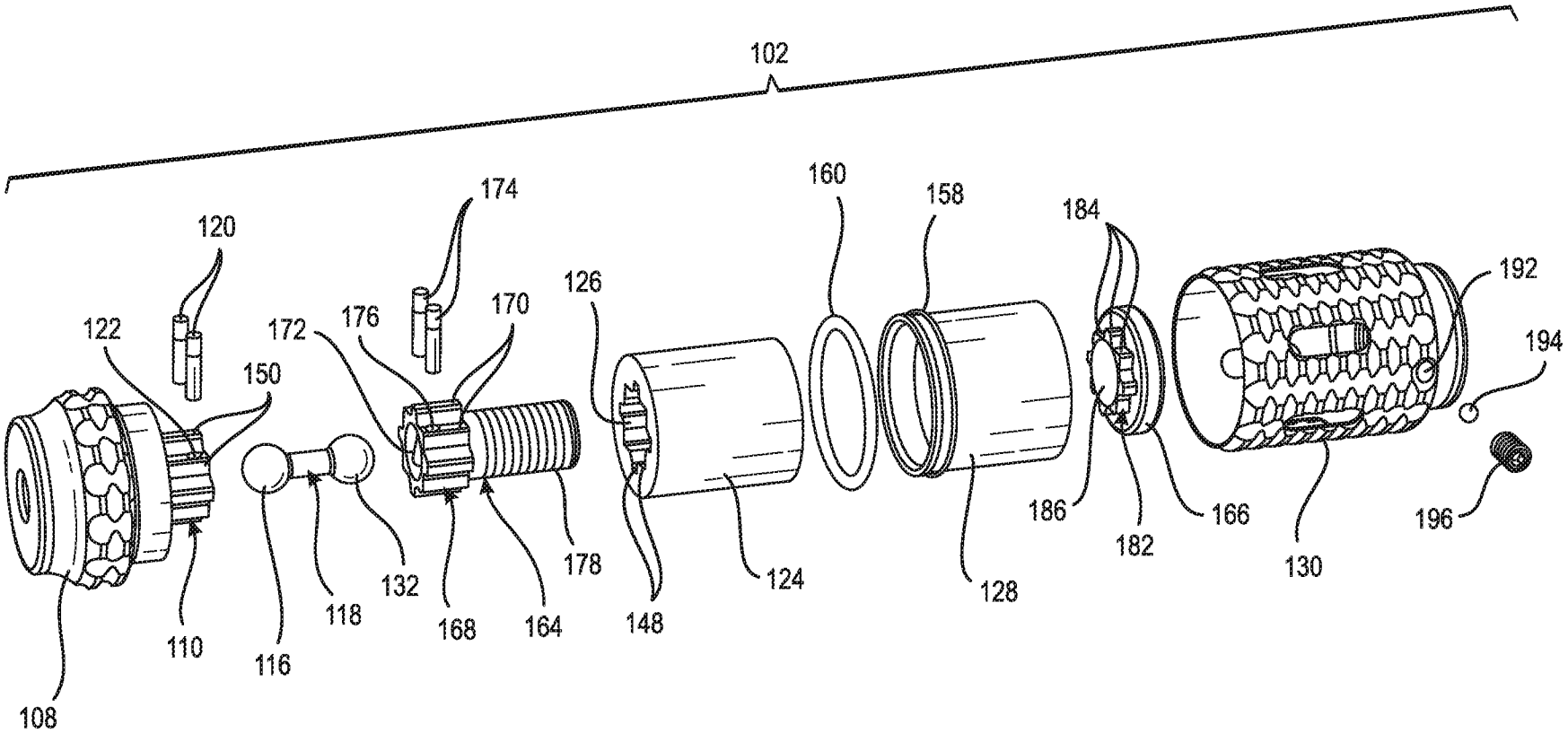
FIG. 6 is an exploded perspective view of the dampener of FIG. 5.
Figure 7:
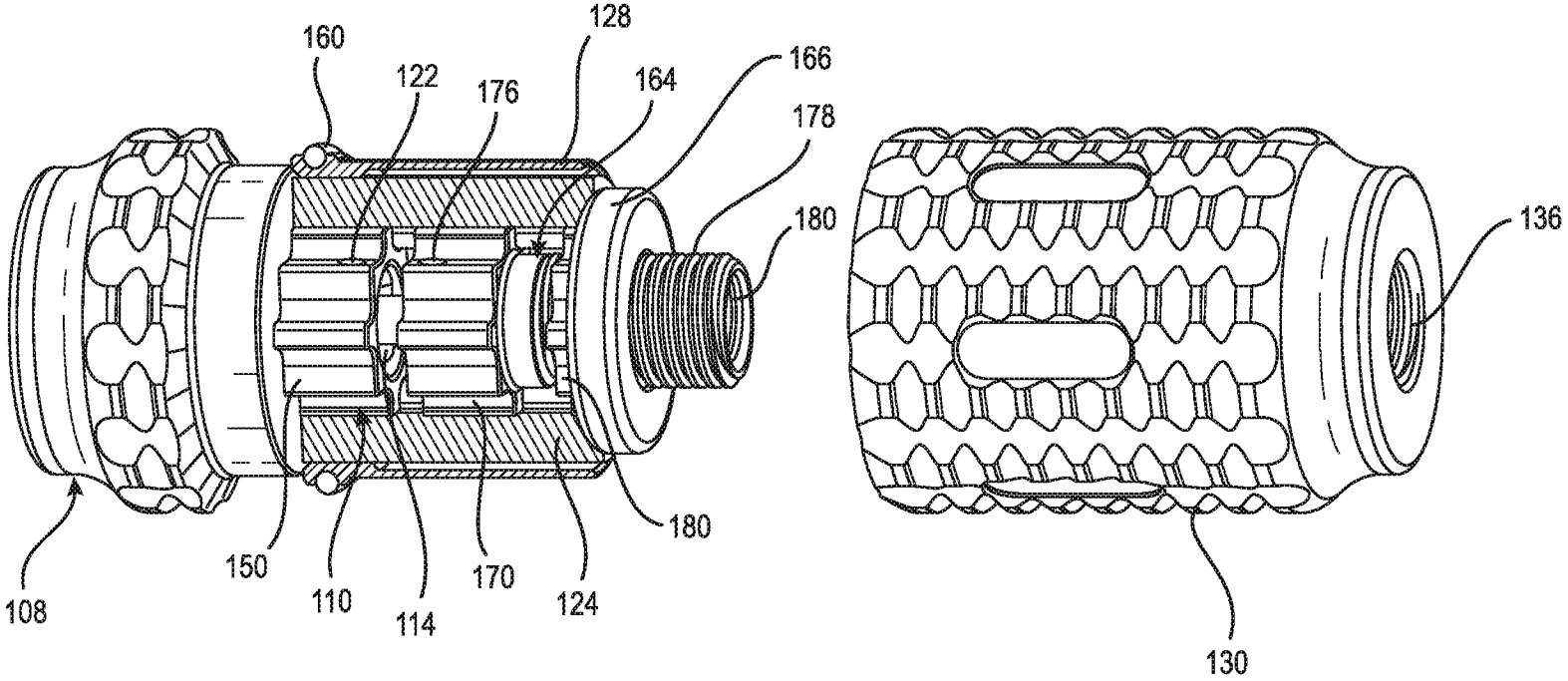
FIG. 7 is partial sectional and exploded perspective view of the dampener of FIG. 5 taken along its axis.

The vibration dampener includes a base 8 including a coupler portion 10 extending from one surface thereof. The base contains a threaded opening 12 as shown in FIG. 4 for receiving a threaded rod (not shown) on which a plurality of the weights may be arranged. Thus, the base is arranged at the far end of the dampener relative to the stabilizer.

The base coupler portion 10 contains an opening 14 which is configured to receive a first end 16 of a coupler pin 18. More particularly, the opening 14 affords access to a chamber in the coupler portion. The coupler pin first end 16 has at least a partial spherical configuration. Dowel pins 20 pass through openings 22 in the base coupler portion to retain the coupler pin first end 16 within the base coupler portion as shown in FIG. 4.

Figure 3:
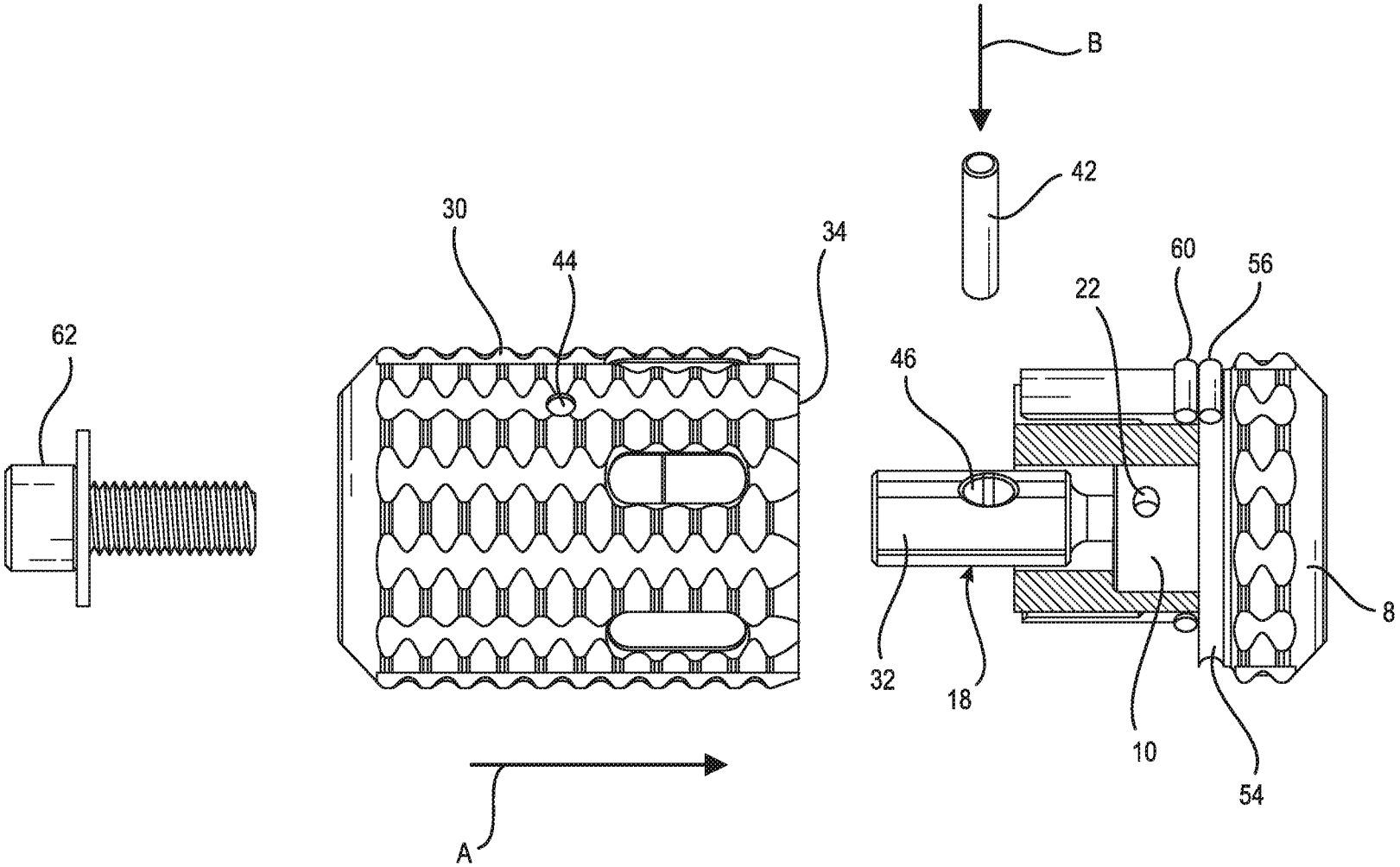
FIG. 3 is a partial sectional and exploded view of the dampener of FIG. 1 taken along its axis.

A generally cylindrical elastomeric or rubber member 24 is provided and contains an axial through opening 26 which receives the coupler pin 18 as shown in FIGS. 3 and 4. As will be developed below, the elastomeric member is unitary and designed to absorb vibrations within the dampener. It may include a pair of opposed journals (not shown) within the inner opening to form a portion of the interior of the elastomeric member. A cylindrical sleeve 28 surrounds the elastomeric member.

A compression member 30 is connected with a second end 32 of the coupler pin 18. The second end 32 of the coupler pin 18 is shown with flattened portions, but those of ordinary skill in the art will appreciate that the end may alternatively have a cylindrical configuration. The end surface of the second end of the couplet pin contains a threaded opening 33. The compression member is generally cylindrical and contains a chamber 34 in the end facing the base 8. The compression member contains a threaded opening 36 and includes a projection 38 extending from an interior end wall within the compression member chamber as shown in FIG. 4. The projection contains an unthreaded opening 40 which is aligned with the threaded opening 36. The opening 40 of the compression member projection 38 is adapted to receive the second end 32 of the coupler pin as shown in FIG. 4. A dowel pin 42 passes through an opening 44 in the compression member and an opening 46 in the coupler pin to connect the coupler pin with the compression member to fully assemble the dampener as shown in FIG. 4. When assembled, the elastomeric member extends between the base 8 and the compression member 30 with the coupler pin 18 extending through the opening 26 in the elastomeric member. The base, coupler pin, elastomeric member, sleeve, and compression member are coaxial.

In an alternate embodiment (not shown), the through opening of the elastomeric member contains a plurality of channels extending in the axial direction. The outer radial surface of the base coupler portion 10 may include a plurality of flutes and the external outer radial surface of the compression member projection 38 may include a plurality of flutes. The flutes of the base coupler portion and the compression member projection, respectively, engage the channels of the elastomeric member through opening when the dampener is assembled to prevent the elastomeric member from rotating relative to the base and the compression member.

In addition, the base 8 preferably includes an annular seat 54 about the outer surface of the base adjacent to the coupler portion to receive an O-ring 56. Similarly, the sleeve 28 preferably includes an annular seat 58 at the end facing the base to receive an O-ring 60. The O-ring 56 provides flexible alignment between the base and the forward most portion of the compression member when the dampener is assembled as shown in FIG. 4. The O-ring 60 provides flexible alignment between the compression member and the cylindrical sleeve. While two O-rings are shown, it will be apparent to those of ordinary skill in the art that the dampener can be constructed with only one O-ring.

In the first embodiment shown in FIGS. 1-4, the dampener has a fixed pressure. This is established during assembly of the dampener, Referring to FIGS. 3 and 4, an auxiliary screw 62 is provided. This screw is inserted through the threaded opening 36 (FIG. 4) of the compression member 30 and into the threaded opening 33 in the second end 32 of the coupler pin 18. Tightening the screw 62 displaces the compression member toward the base as shown by the arrow A, with the inner surface of the compression member at the end of the chamber 34 abutting against one end surface of the elastomeric member. The other end surface of the elastomeric member abuts against the base in the region around the coupler portion. As the compression member is displaced, pressure against both ends of the elastomeric member 24 causes it to expand radially and press against the inner surface of the cylindrical sleeve 28. When the opening 44 in the compression member is aligned with the opening 46 in the coupler pin 13, the dowel 42 is inserted into the openings 44, 46 as shown by the arrow B to retain the compression Member in place while exerting constant pressure on the elastomeric member. The auxiliary screw 62 is then removed.

The dampener 2 is then connected with the stabilizer 4 which in turn is connected with a bow (not shown), with or without the annular weights 6 with the compression member 30 being arranged toward the bow as shown in FIG. 1. When the bow with which the stabilizer is connected is operated, the elastomeric member of the dampener absorbs vibrations resulting in the bow when an arrow is shot. The spherical configuration of the one end of the connector pin allows oscillation of the pin in any radial direction within the base coupler portion. The dampener supports additional weights 6 without sagging.

Turning now to FIGS. 5-8, a second embodiment of the invention will be described. This embodiment is similar to that described above except that the dampening effect of the dampener is adjustable according to the desires of the user.

As in the first embodiment of FIGS. 1-4, the dampener 102 of the second embodiment is mounted on a bow stabilizer 104 together with weights 106. The dampener includes a base 108. As distinguished from the non-adjustable dampener of the embodiment of FIGS. 1-4, the base is connected with the stabilizer and thus is arranged toward the bow. Thus, in the embodiment of FIGS. 5-8, components similar to those of FIGS. 1-4 are reversed in relation to the bow. The base includes a coupler portion 110 having a plurality of radially extending flutes 150 on an outer surface thereof. A coupler pin 118 has a first end 116 arranged in an opening 114 of the coupler portion. A pair of dowels 120 are arranged in openings 122 of the coupler portion to retain the first end of the coupler pin within the coupler portion. A cylindrical elastomeric member 124 contains an axial through opening 126 which receives the coupler pin 118. A hollow cylindrical sleeve 128 surrounds the elastomeric member. A compression member 130 envelops the cylindrical sleeve. The compression member includes a threaded opening 136.

Unlike the first embodiment, the dampener 102 of the second embodiment includes an adjustable compression assembly including a pull stud 164, a press plate 166, and the compression member 130. The pull stud is similar to a bolt and has a first end 168 having a plurality of radially extending flutes 170. The first end contains an opening 172 for receiving the second end 132 of the coupler pin. The second end 132 of the coupler pin is retained in the first end opening 172 by a pair of dowels 174 which pass through respective openings 176 (only one of which is shown) in the pull stud first end. The second end of the pull stud has threads 178 on the exterior surface thereof. In addition, the second end contains a threaded opening 180. The first and second ends 116, 132 of the coupler pin have a spherical configuration to allow the pin to oscillate within the base coupler portion and the pull stud first end, respectively.

Figure 8:
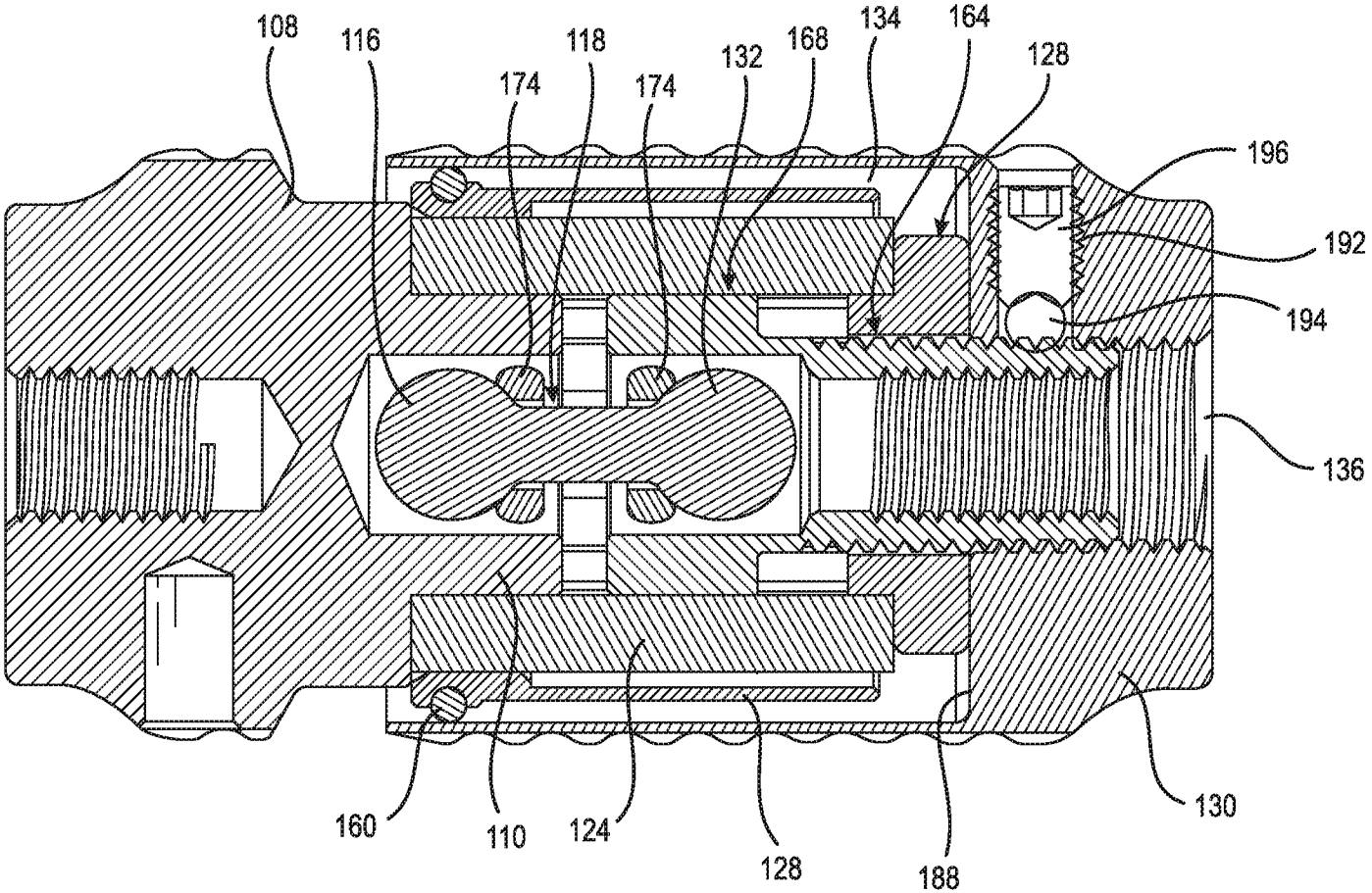
FIG. 8 is a sectional view of the assembled dampener of FIG. 5 taken along its axis.

The press plate 166 includes a projection 182 containing a plurality of radially extending flutes 184. The press plate further contains an axial through opening 186. As shown in FIG. 8, the second end of the pull stud 164 passes through the axial opening of the press plate. The flutes of the base coupler member, the pull stud, and the press plate are arranged in grooves 148 extending axially within a through opening 126 of the elastomeric member 124. Accordingly, the base, pull stud and press plate serve to prevent the elastomeric member from rotating about its axis relative to these components.

The compression member 130 is operable to adjust the dampening effect of the dampener 102. Referring to FIG. 8, the compression member includes a chamber 134 which terminates at an inner wall 188 of the compression member. The pull stud 164 having a threaded exterior surface 178 projects through the inner wall 188 of the compression member. The threads of the threaded opening 136 of the compression member 130 engage the threads 178 of the pull stud second end. Rotation of the compression member thus displaces the member axially relative to the pull stud. As the compression member is rotated in a first direction, the pull stud draws the compression member against the press plate which in turn axially compresses the elastomeric member between the base and the press plate. The axial compression causes the elastomeric member 124 to expand radially against the inner wall surface of the cylindrical sleeve 128. As the displacement of the compression member toward the base of the dampener increases, the compression of the elastomeric member increases as well. As the compression of the elastomeric member increases, the ability to absorb vibrations changes as the adjustable dampener becomes stiffer allowing more weight to be added without sag. Accordingly, the dampening effect of the dampener can be adjusted by the archer to his or her personal preference by rotating the compression member.

Once the compression member has been adjusted to define the amount of vibration that may be absorbed by the elastomeric member, and thus the dampening effect of the dampener, the compression member can be locked into place. Accordingly, the compression member includes a radial threaded opening 192 in which an acetal plastic or nylon ball 194 is arranged. A set screw 196 is threaded into the opening 192 and squeezes the ball against the second end of the pull stud. Pressure from the set screw and ball prevents the compression member from rotating relative to the pull stud and thus maintains the compression member in the selected position without damage to the threads.

Another difference between the fixed and adjustable dampeners described above is that the adjustable dampener includes only one O-ring 160 which is arranged in an annular seat 158 at the end of the cylindrical sleeve 128 extending toward the base 108. This O-ring provides flexible alignment between the compression member 130 and the sleeve 128 as shown in FIG. 8.

Turning now to FIGS. 9-12, a third embodiment of a vibration dampener will be described. This embodiment is a preferred embodiment of an adjustable vibration dampener in that it provides upper and lower limits to the dampening pressure and thus improves the performance of the dampener.

Figure 9:
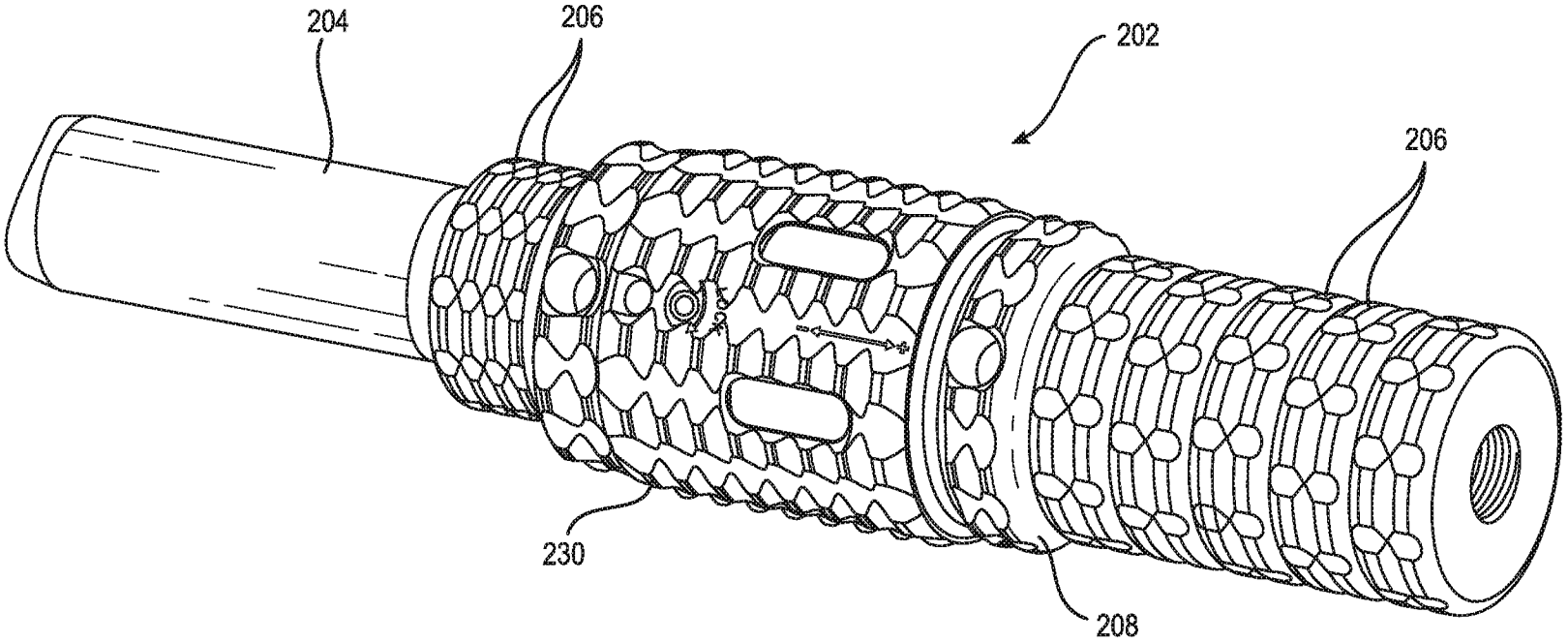
FIG. 9 is a front perspective view of a third embodiment of a vibration dampener mounted on an archery bow stabilizer according to the disclosure.

As in the first and second embodiments, the vibration dampener 202 is mounted on a stabilizer 204 via a screw connection as shown in FIG. 9. A plurality of annular weights 206 may also be amounted on the stabilizer adjacent to one or both ends of the dampener.

Figure 10:
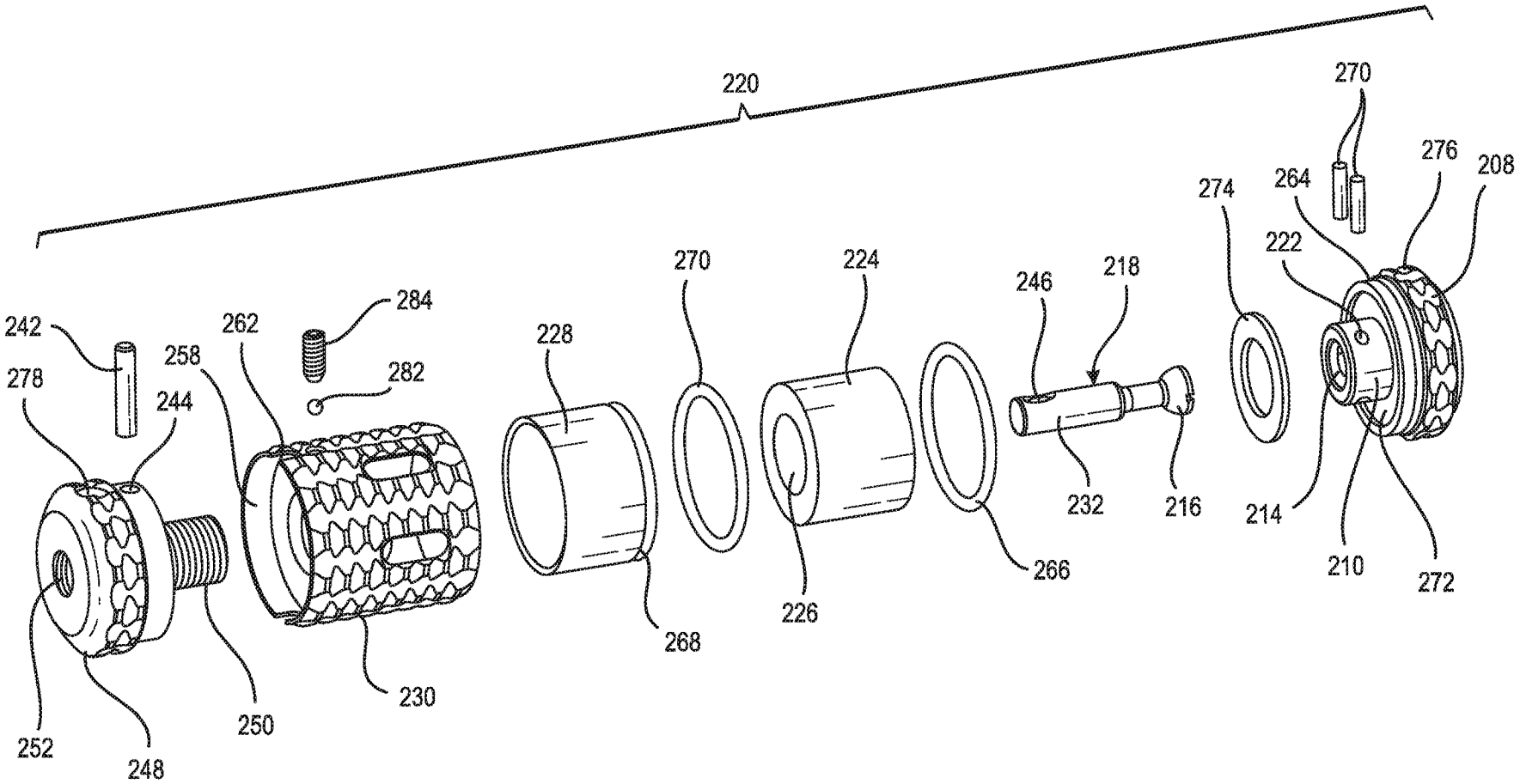
FIG. 10 is an exploded perspective view of the dampener of FIG. 9.
Figure 11:
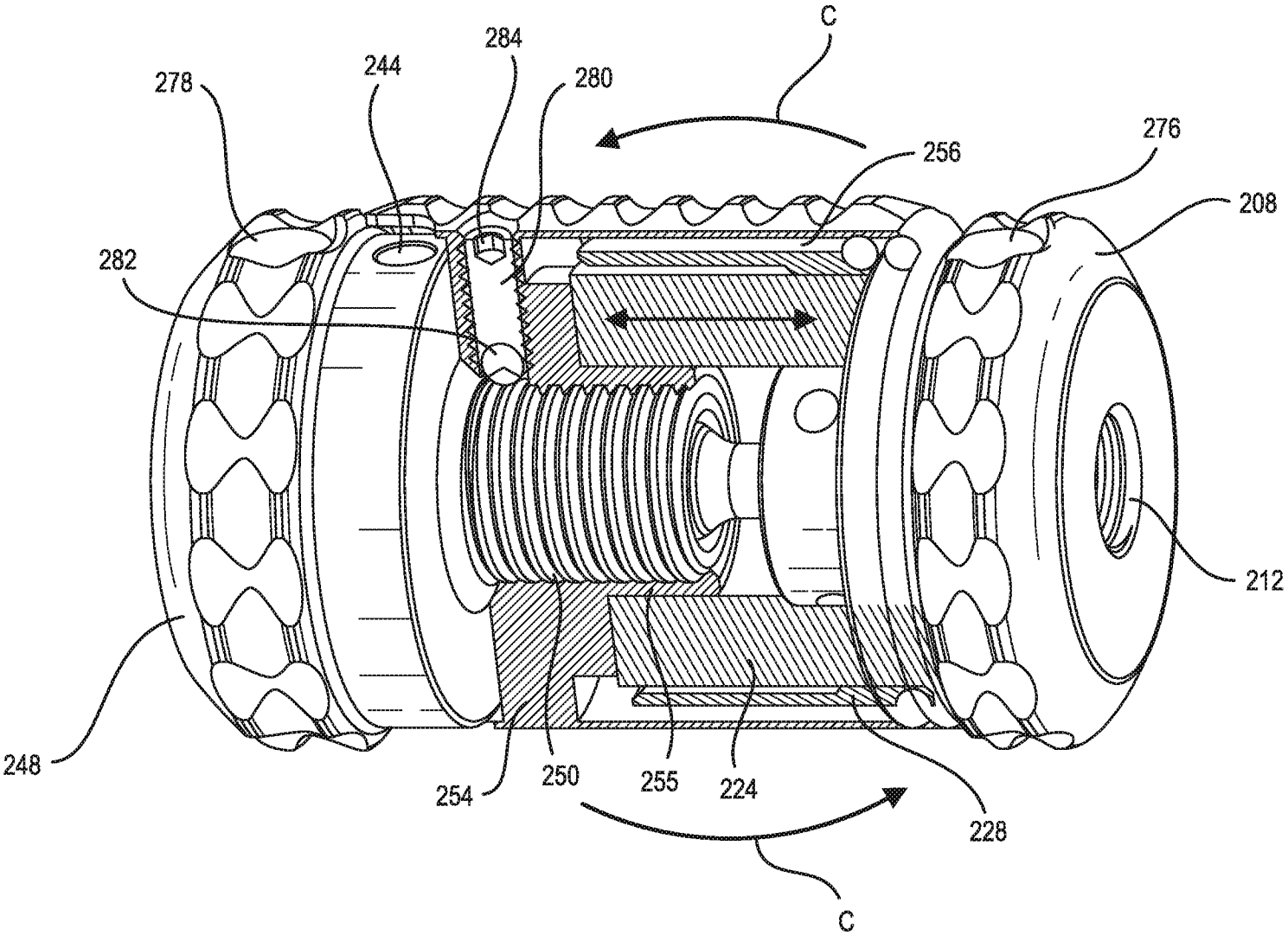
FIG. 11 is a partial sectional perspective view of the dampener of FIG. 9 taken along its axis.
Figure 12:
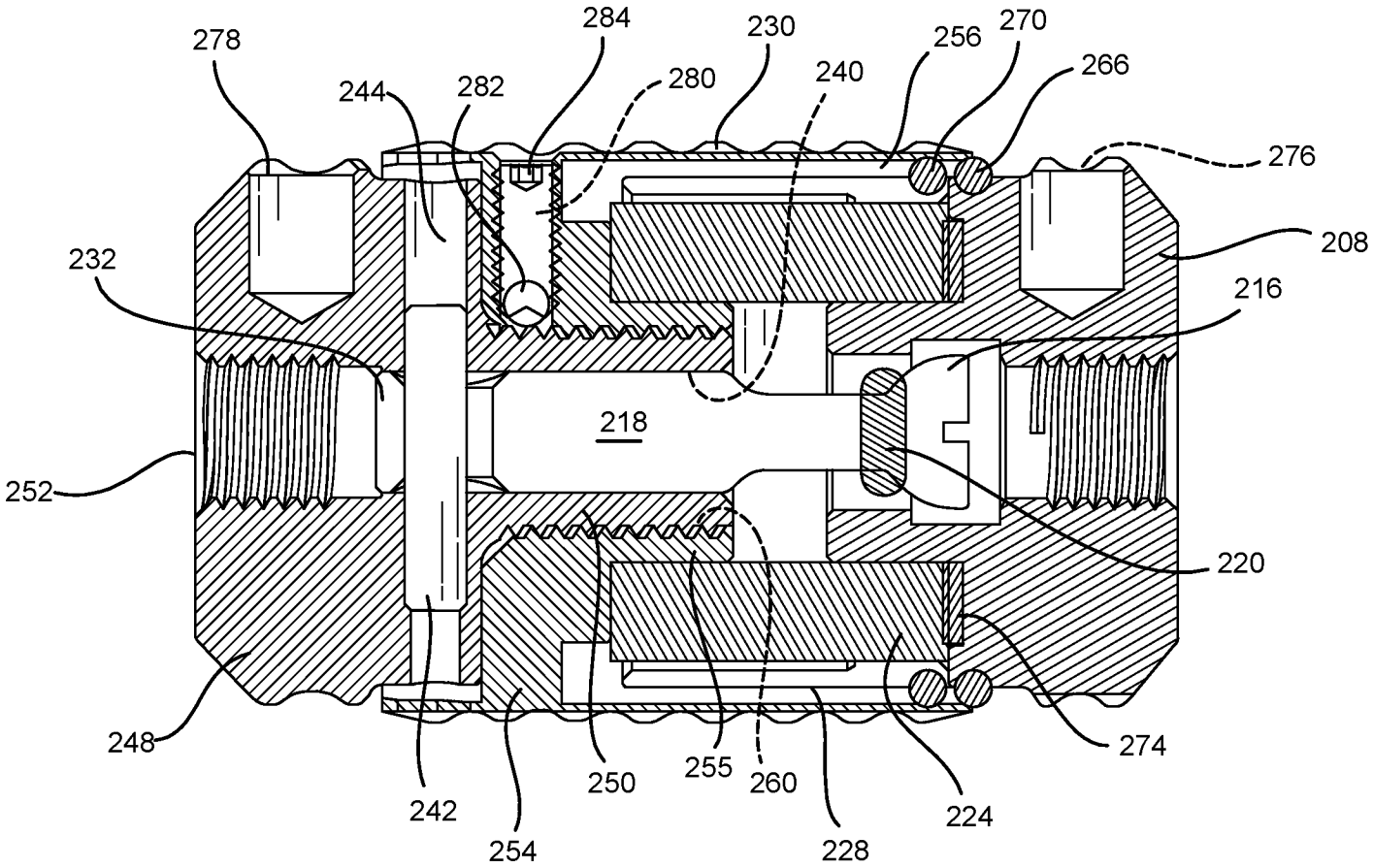
FIG. 12 is a section view of the dampener of FIG. 9 taken along its axis.

Referring to FIGS. 10-12, the vibration dampener includes a first base 208 including a coupler portion 210. The first base contains a threaded opening 212 as shown in FIG. 11 for receiving a threaded rod on which a plurality of the weights may be arranged. The first base 208 is thus arranged at the far end of the dampener relative to the stabilizer.

The first base coupler portion 210 contains an opening 214 which receives a first end 216 of a coupler pin 218. The opening 214 affords access to a chamber in the coupler portion. The coupler pin first end 216 has at least a partial spherical configuration and contains a slot in the end surface for receiving a screwdriver as will be developed below. Dowel pins 220 pass through openings 222 in the first base coupler portion to retain the coupler pin first end 216 within the first base coupler portion as shown in FIG. 12.

A generally cylindrical elastomeric or rubber member 224 is provided and contains an axial through opening 226 which receives the coupler pin 218 as shown in FIG. 12. A cylindrical sleeve 228 surrounds the elastomeric member.

A second base 248 is connected with a second end 232 of the coupler pin 218 as shown in FIGS. 11 and 12. The second base includes a threaded projection 250 which contains an unthreaded opening 240 which is adapted to receive the second end 232 of the coupler pin 218. A dowel pin 242 passes through an opening 244 in the second base and an opening 246 in the coupler pin second end to connect the coupler pin between the first and second bases. The end of the second base 248 contains a threaded opening 252 for connection with the stabilizer.

A compression member in the form of an adjustment tube 230 is connected with the projection of the second base and arranged between the first and second bases. The adjustment tube is generally cylindrical and contains an interior wall 254 which divides the interior of the tube into a first chamber 256 in the end facing the first base 208 for receiving the cylindrical sleeve 228 and the elastomeric member 224 and a second chamber 258 in the end facing the second base 248 for receiving a portion of the base as shown in FIGS. 11 and 12. The interior wall 254 contains a threaded opening 260 which receives the threaded projection 250 of the second base. The adjustment tube is thus mounted on the second base projection during assembly of the dampener. The interior wall further includes a portion 255 which projects from the wall and into the elastomeric member opening 226 as shown in FIGS. 11 and 12. A slot or recess 262 in the adjustment tube is provided to allow the installation of the dowel pin 242 to connect the second base with the second end 232 of the coupler pin 218.

The first base 208 includes an annular seat 264 about the outer surface adjacent to the coupler portion to receive an O-ring 266 and the cylindrical sleeve 228 includes an annular seat 268 at the end facing the base to receive an O-ring 270. The O-ring 266 provides flexible alignment between the base and the forward most portion of the compression member when the dampener is assembled as shown in FIG. 12. The O-ring 270 provides flexible alignment between the compression member and the cylindrical sleeve. While two O-rings are shown, it will be apparent to those of ordinary skill in the art that the dampener can be constructed with only one O-ring.

The first base 208 further includes an annular recess 272 in the surface facing the elastomeric member 224 as shown in FIG. 10. The recess is configured to receive one or more non-stick rings such as a nylon washer 274 which is arranged between the elastomeric member and the first base when the dampener is assembled to permit the elastomeric member to rotate relative to the first base as will be developed below.

When the dampener of FIGS. 9-12 is assembled, the elastomeric member receives the projection 255 of the interior wall of the adjustable tube and extends between the adjustable tube inner wall 254 and the nylon washer 274. Rotation of the adjustment tube 230 as shown by the arrows C in FIG. 11 displaces the tube relative to the second base. Thus, the tube moves toward and away from the first base depending on the direction of rotation. Rotation of the adjustment tube in a first direction displaces the tube toward the first base axially compresses the elastomeric member 224 increases the pressure within the elastomeric member causing it to expand radially against the inner surface of the cylindrical sleeve. Conversely, rotation of the tube in a second direction opposite the first direction displaces the tube away from the first base reducing the pressure within the elastomeric member and allowing it to return to a more relaxed state, thereby reducing the pressure on the cylindrical sleeve.

By positioning the first and second bases relative to each other, the longitudinal distance along which the adjustment tube is restricted, thereby to establish maximum and minimum pressures on the elastomeric member. Adjustment of the adjustment tube 230 and second base 248 is accomplished using hex wrenches which may be inserted into an opening (not shown) in the adjustment tube and opening 278 in the second base, respectively, to rotate these parts as necessary. If there were no such restrictions on the longitudinal movement of the adjustment tube, the elastomeric member would not function properly to absorb vibrations. That is, if the elastomeric member is not pressurized enough to press against the cylindrical sleeve when the bow is operated to shoot an arrow, the vibration forces would not be contained within the elastomeric member by the sleeve, thereby rendering the device ineffective in reducing vibration. Similarly, if the elastomeric member is pressurized above its limit of elasticity, it becomes too rigid, thereby reducing its ability to absorb vibrations.

Once the adjustment tube has been rotated by the user to establish the desired pressure and thus vibration absorbancy of the elastomeric member, the tube can be locked into place. For this purpose, the adjustable tube includes a radial threaded opening 280 in which an acetal plastic or nylon ball 282 is arranged. A set screw 284 is threaded into the opening 280 and presses the ball against threaded projection 250 of the second base. Pressure from the set screw and ball prevents the adjustment tube from rotating relative to the second base and thus maintains the adjustment tube in the selected position.

The first and second bases, coupler pin, cylindrical sleeve, dowels and compression member are all formed of a durable material such as metal or a synthetic plastic/ceramic material, whereas the elastomeric member is formed of a more pliable material such as rubber.

While the preferred forms and embodiments of the archery stabilizer tube have been illustrated and described, it will be apparent to those of ordinary skill in the art that various changes and modifications may be made without deviating from the novel concepts thereof.

What is claimed is:

1. A vibration dampener, comprising (a) a hollow cylindrical compression member having a closed end and an open end;

(b) a base closing said compression member open end;

(c) a cylindrical sleeve mounted on said base and arranged in said compression member, said cylindrical sleeve containing a chamber; and (d) an elastomeric member arranged in said chamber, said elastomeric member being pressurized by said compression member and said base to press against an inner surface of said sleeve, whereby vibration is absorbed by said elastomeric member.

2. A vibration dampener, comprising (a) a base including a coupler portion;

(b) a cylindrical sleeve mounted on said base and containing a chamber;

(c) an elastomeric member arranged in said chamber and connected with said coupler portion; and (d) a coupler pin having a first end connected with said coupler portion of said base, said elastomeric member being pressurized to press against an inner surface of said sleeve, whereby vibration is absorbed by said elastomeric member.

3. A vibration dampener as defined in claim 2, wherein said coupler pin first end has a spherical configuration to afford oscillation within said coupler portion of said base.

4. A vibration dampener as defined in claim 3, wherein said base coupler portion contains at least one through opening for receiving a dowel pin to retain said coupler pin first end within said coupler portion of said base.

5. A vibration dampener as defined in claim 2, and further comprising a compression member connected with a second end of said coupler pin, said cylindrical sleeve and said elastomeric member being arranged between said base and said compression member.

6. A vibration dampener as defined in claim 2, wherein said compression member has a cylindrical configuration and contains an opening in a side wait portion thereof and wherein said second end of said coupler pin contains a through opening, and further comprising a second dowel pin which passes through said compression member opening and said coupler pin through opening to connect said compression member with said coupler pin, thereby applying pressure to said elastomeric member.

7. A vibration dampener as defined in claim 6, wherein said elastomeric member has a cylindrical configuration and contains an axial through opening, an inner surface of said elastomeric member surrounding said through opening containing a plurality of axial channels, said base coupler portion having external flutes which engage said channels of said elastomeric member through opening to prevent rotation of said elastomeric member relative to said base.

8. A vibration dampener as defined in claim 7, wherein said compression member includes a projection having external flutes which engage said channels of said elastomeric member through opening.

9. A vibration dampener as defined in claim 7, and further comprising a second O-ring between said compression member and said cylindrical sleeve.

10. A vibration dampener as defined in claim 2, and further comprising a first O-ring arranged between said compression member and said base.

11. A vibration dampener, comprising (a) a base including a coupler portion;

(b) a cylindrical sleeve mounted on said base and containing a chamber;

(c) an elastomeric member arranged in said chamber and connected with said coupler portion, said elastomeric member being pressurized to press against an inner surface of said sleeve;

(d) a coupler pin having a first end connected with said coupler portion of said base, said coupler pin first end having a spherical configuration to afford oscillation within said coupler portion of said base; and (e) a compression assembly to adjust the pressure applied to said elastomeric member, whereby vibration is absorbed by said elastomeric member.

12. A vibration dampener as defined in claim 11, wherein said compression assembly is connected with said coupler pin to adjust the pressure of said elastomeric member and its force against said chamber inner surface.

13. A vibration dampener as defined in claim 12, wherein said compression assembly includes a pull stud having one end connected with a second end of said coupler pin and a threaded end, a compression member threadably connected with said pull stud threaded end, and a press plate arranged between said elastomeric member and said compression member, whereby rotation of said compression member in opposite directions relative to said pull stud displaces said press plate toward and away from said elastomeric member to control the pressure applied to said elastomeric member.

14. A vibration dampener as defined in claim 13, wherein said compression member includes a set screw which is operable to lock said compression member in a selected position relative to said pull stud.

15. A vibration dampener as defined in claim 13, wherein said press plate includes a projection and said base coupler portion and said press plate projection each have a fluted outer surface which engages said channels of said elastomeric member through opening, respectively, said pull stub first end being arranged within said elastomeric member through opening between said base coupler portion and said press plate projection.

16. A vibration dampener as defined in claim 15, wherein said coupler pin first and second ends each have a spherical configuration to afford oscillation within said coupler portion of said base and within said first end of said pull stud.

17. A vibration dampener as defined in claim 16, and further comprising an O-ring arranged between said cylindrical sleeve and said compression member.

18. A vibration dampener as defined in claim 12, wherein said elastomeric member has a cylindrical configuration and contains an axial through opening, an inner surface of said elastomeric member surrounding said through opening containing a plurality of axial channels, said pull stud one end containing external flutes which engage said channels of said elastomeric member through opening to prevent rotation of said elastomeric member relative to said pull stud.

19. A vibration dampener, comprising (a) a cylindrical sleeve containing a chamber, (b) an elastomeric member arranged in said chamber, and (c) a compression assembly to adjust a pressure applied to said elastomeric member, said compression assembly including an adjustment tube which rotates and axially compresses said elastomeric member to press said elastomeric member radially against an inner surface of said sleeve to a selected degree, whereby vibration is absorbed by said elastomeric member.

20. A vibration dampener as defined in claim 19, and further comprising first and second base members which are connected with said adjustment tube to limit the rotation of said adjustment tube to define a range of pressure applied to said elastomeric member.

21. A vibration dampener as defined in claim 20, and further comprising a coupler pin extending through said elastomeric member, said coupler pin being connected at its opposite ends with said first and second base members, respectively.

22. A vibration dampener as defined in claim 21, wherein a first end of said coupler pin contains a laterally extending through opening and a second end of said coupler pin has a partially spherical configuration.

23. A vibration dampener as defined in claim 22, wherein said first base member includes a threaded extension containing a longitudinally extending opening for receiving said coupler pin first end and a laterally extending opening, and further comprising a first dowel pin arranged in said first end laterally extending opening and in said coupler pin laterally extending through opening to connect said coupler pin with said first base member.

24. A vibration dampener as defined in claim 23, wherein said second base member includes an extension containing a longitudinal opening for receiving said coupler pin second end and a spaced pair of laterally extending openings, and further comprising a pair of second dowel pins arranged in said second base member openings, respectively, and extending against said coupler pin second end to retain said coupler pin second end within said longitudinal opening.

25. A vibration dampener as defined in claim 24, wherein said adjustment tube contains a threaded radial opening, and further comprising a ball and a set screw arranged in said threaded radial opening, said set screw being operable to press said ball against said first base member threaded extension to lock said adjustment tube in place.

26. A vibration dampener as defined in claim 20, wherein said first base member includes a threaded extension and said adjustment tube contains a threaded internal surface for rotatably connecting said adjustment tube with said first base member, whereby said adjustment tube is displaced along said first base member threaded extension between said first and second base members.

27. A vibration dampener as defined in claim 26, wherein said adjustment tube has an internal surface which abuts against an end surface of said elastomeric member.

28. A vibration dampener as defined in claim 27, wherein said second base member includes an end surface which abuts against an opposite end surface of said elastomeric member, whereby said elastomeric Member is axially compressed between said adjustment tube and said second base member when said adjustment tube is rotated in a first direction to displace said adjustment tube toward said second base member.

29. An adjustable vibration dampener as defined in claim 28, and further comprising a nylon washer arranged between said opposite end surface of said elastomeric member and said second base member end surface, thereby to permit said elastomeric member to rotate relative to said second base member.

30. A vibration dampener as defined in claim 20, and further comprising a first O-ring arranged between said adjustment tube and said second base member.

31. A vibration dampener as defined in claim 30, and further comprising a second O-rung arranged between said adjustment tube and said cylindrical sleeve.

* * * * *